United States Patent [19]

Silverman et al.

[11] Patent Number: 4,868,579

[45] Date of Patent: Sep. 19, 1989

[54] REDUCED BACK LOBE SPIRAL ANTENNA

[75] Inventors: Lawrence H. Silverman, Dix Hills; Shakeel Siddiqi, Farmingdale, both of N.Y.

[73] Assignee: General Instrument Corporation, New York, N.Y.

[21] Appl. No.: 293,553

[22] Filed: Jan. 3, 1989

Related U.S. Application Data

[63] Continuation of Ser. No. 441,031, Nov. 12, 1982, abandoned.

[51] Int. Cl.[4] ..... H01Q 1/36

[52] U.S. Cl. ..... 343/895

[58] Field of Search ..... 343/895, 898, 787, 789, 343/790

[56] References Cited

U.S. PATENT DOCUMENTS

| | | | |
|---|---|---|---|
| 3,686,674 | 8/1972 | Clasby et al. | 343/895 |
| 4,032,921 | 6/1977 | Sikina Jr. et al. | 343/895 |
| 4,085,406 | 4/1978 | Schmidt et al. | 343/895 |
| 4,459,596 | 7/1984 | Flam | 343/895 |

*Primary Examiner*—Theodore M. Blum

*Attorney, Agent, or Firm*—Hopgood, Calimafde, Kalil, Blaustein & Judlowe

[57] ABSTRACT

A ferrite sleeve placed about the cavity portion of an antenna reduces back lobe radiation without degrading the antenna's front hemisphere radiation pattern. The thickness of the ferrite sleeve is selected such that the sleeve highly attenuates the surface currents on the cavity at the lower end of the operating frequency range of the antenna.

7 Claims, 2 Drawing Sheets

REDUCED BACK LOBE SPIRAL ANTENNA

The invention described herein may be manufactured by or for the Government of the United States for governmental purposes without the payment of any royalties thereon or therefor.

This application is a continuation of application Ser. No. 441,031 filed Nov. 12, 1982, now abandoned.

The present invention relates generally to high-frequency antennas.

Antennas capable of transmitting high-frequency signals, typically in the range of between 5 to 20 GHz, are employed in such varied applications as communications, radar systems, and electronics countermeasures systems. One type of antenna construction employed for such high-frequency applications is a cavity-backed spiral antenna in which a radiating element in the form of two interweaved spiral-shaped conductors is located on one surface of a cylindrical conductive member, the interior of which defines a cavity. Microwave energy is applied to the antenna by means of a microwave connector connected to the opposite or back surface of the cylinder.

In antennas of this general construction, it has been found that high-frequency currents generated on the outer surface of the cylindrical conductive member may produce a significant backlobe pattern of radiation, which, when received by a nearby receiving antennas, will cause interference with the reception of other signals at the receiving antennas.

Prior attempts at reducing this undesired back lobe radiation, particularly in those applications in which a broad frequency range of signals is to be transmitted by the antenna, have caused either a degradation in the antenna's front lobe radiation pattern or required an increase in the size or diameter of the antenna to maintain the desired front lobe radiation. Since these results are undesirable from either a technical and/or an economic point of view, no satisfactory means has yet been devised to effectively reduce back-lobe radiation in such antennas as cavity-backed spiral antennas designed to transmit a wide range of frequencies.

It is an object of the invention to provide an antenna of the type described in which back lobe radiation is significantly reduced over a wide range of frequencies.

It is a further object of the present invention to provide an antenna of the type described in which back lobe radiation is substantially reduced over a broad frequency range without degrading the forward lobe transmission or increasing the size of the antenna.

To these ends, the antenna of the invention includes a ferrite sleeve placed about the cavity portion of the antenna. The ferrite sleeve is effective to reduce the back lobe radiation pattern without degrading the performance of the front hemisphere radiation pattern. The thickness of the ferrite sleeve is selected such that it is most absorbent of surface currents at frequencies in the lower end of the operating frequency band of the antenna.

To the accomplishment of the above and of such further objects as may hereinafter appear, the present invention relates to an antenna substantially as defined in the appended claims, and as described in the following detailed specification as considered along with the accompanying drawings in which:

Figure 1:
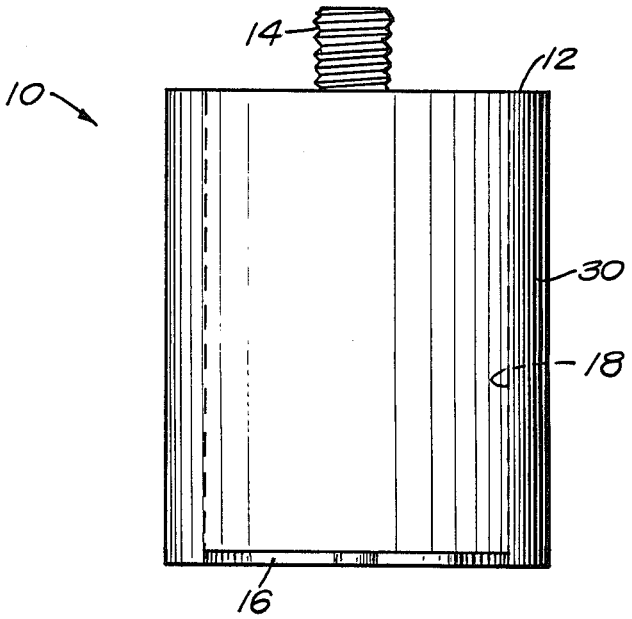
FIG. 1 is a schematic plan view of an antenna in accordance with the principles of the invention.
Figure 2:
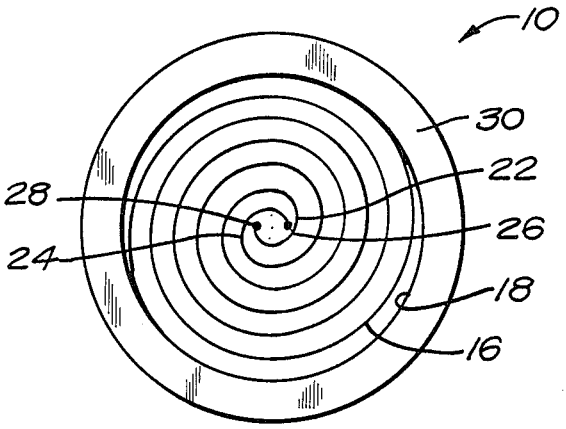
FIG. 2 is a schematic front elevation of the antenna of FIG. 1.

In the embodiment illustrated in FIGS. 1 and 2, the invention is shown as employed in a cavity-backed spiral antenna for purposes of example, it being understood that the invention may also be used to comparable advantage in other types of high-frequency broad-band antennas.

As therein shown, a cavity-backed spiral antenna, generally designated 10, includes, as is conventional, a rear conducting surface 12 to which a microwave connector 14 is connected to provide drive energy to the antenna. Rear surface 12 of the antenna is joined to a front radiation surface 16 by means of a cylindrical conducting surface 18, which defines an interior reflecting cavity portion 20.

As shown in FIG. 2, the radiation surface 16 comprises two interweaved spiral conductors 22 and 24 respectively center fed at conduction lands 26 and 28, which may, as is known, be formed by printed circuit techniques on an insulating surface, such as a ceramic or glass. The lands 26 and 28 are connected to the microwave connector 14 by a suitable feed device (not shown in the drawings).

In a conventional antenna of the type thus far described, in addition to the desired front lobe radiation, a considerable amount of back lobe radiation is produced at the rear surface of the antenna, which is wasteful and is also capable of producing undesired interference in many antenna applications. The extent of such undesired back lobe radiation ranges from about −25 dB at the high end of the antenna's operating frequency range to about −10 dB at the low frequency range.

In accordance with the present invention, such back lobe radiation is significantly reduced over a wide frequency range by the placement of a ferrite sleeve 30 about the cavity portion of the antenna. As shown in FIG. 1, ferrite sleeve 30 is preferably arranged around the entire peripheral cylindrical surface of the antenna and extends between the front and rear surfaces 12 and 16. Although this invention comprehends the use of any ferrite microwave-absorbent material as the material for the ferrite sleeve 30, sleeves made of a ferrite material manufactured and sold by the Emerson Cumming Corp. under the designations MF 124 and MF 190 have proven to be particularly effective in reducing back lobe radiation in a cavity-backed spiral antenna of the type illustrated in FIGS. 1 and 2.

Figure 3:
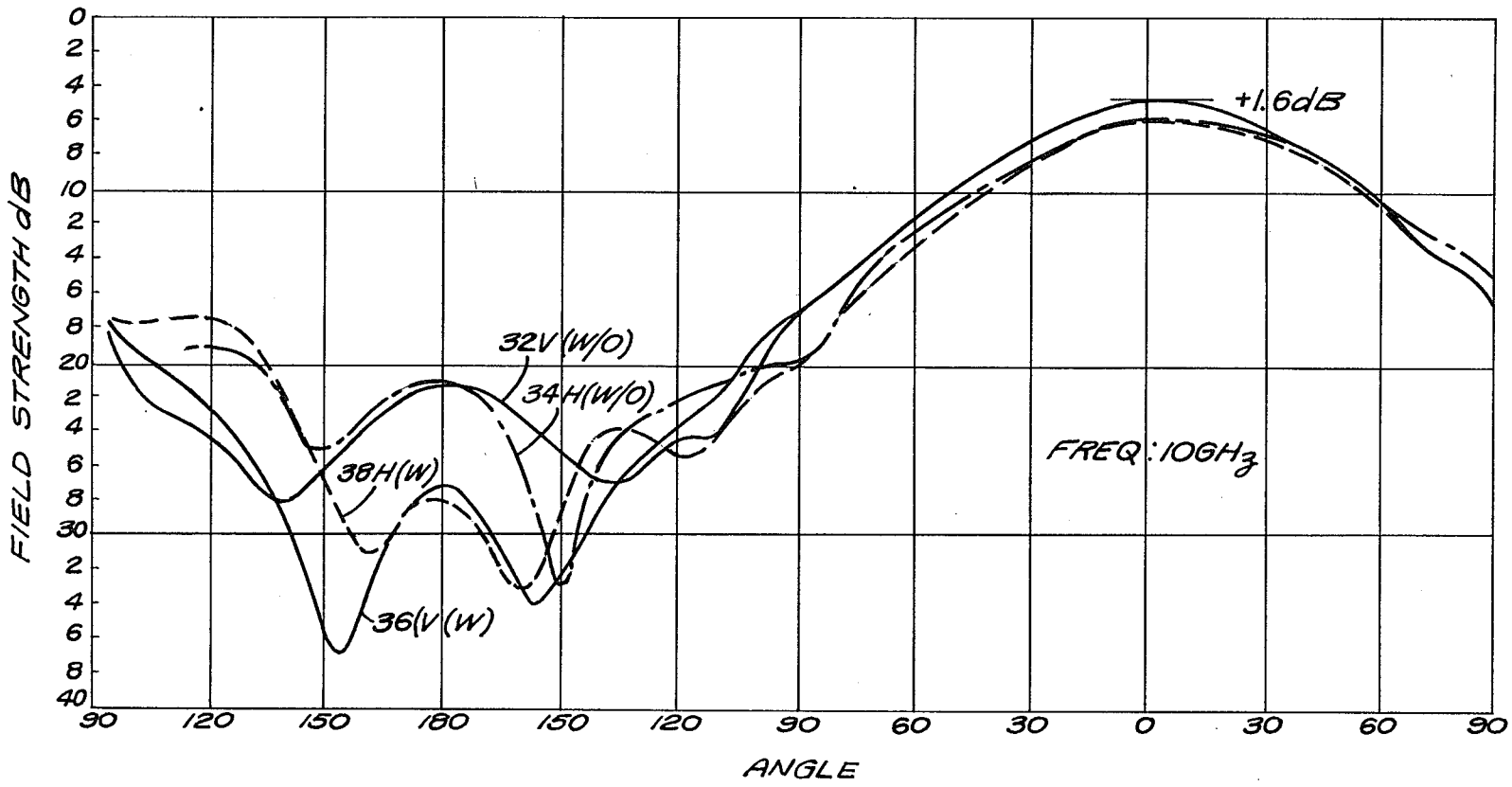
FIG. 3 is a series of antenna patterns comparing the relative field strengths as a function of angle of the antenna of the invention with the corresponding field strength patterns produced in a prior art antenna.

The reduced back lobe radiation achieved by the antenna of the invention is illustrated in FIG. 3, which represents field strength as a function of angle at a frequency of 10 GHz, although equally favorable results have been achieved in an antenna of this type at frequencies between 6 GHz and 18 GHz. The field strength curves 32 and 34 in FIG. 3 are respectively the field strength patterns of the vertically and horizontally polarized waves produced in a conventional spiral antenna, whereas field strength curves 36 and 38 are respectively the vertically and horizontally polarized wave patterns produced in a spiral antenna with a ferrite sleeve arranged thereon according to the present invention, as shown in FIGS. 1 and 2.

As can be seen by a comparison of curves 32 and 34 with curves 36 and 38, the back lobe radiation that occurs at an angle at 180° is considerably reduced, in the order of 7 dB, in the antenna of the invention, whereas the front radiation lobes that occur at an angle of 0° for both the vertically and horizontally polarized waves are essentially the same in both the prior art antenna and the antenna of the invention, differing by only about 1.6 dB. Moreover, the pattern of the front lobe, that is, the desired circular polarization and shape of the front hemisphere, is not modified in the antenna of the invention by the placement of the ferrite sleeve about the antenna cavity portion. Significantly, the level of the back lobe radiation is reduced in the antenna of the invention to an extremely low level, below −20 dB over the entire frequency band of 6 to 18 GHz; more particularly, back lobe radiation is reduced to −20 dB at a frequency of 6 GHz and is gradually reduced still further to −26 dB at a frequency of 18 GHz. In contrast, the conventional cavity-backed spiral antenna typically probes back lobe levels, which, as noted previously, range from about −25 dB at 18 GHz to −10 dB at 6 GHz. In addition, the beamwidth of the back lobe in the antenna of the invention is narrowed but circular polarization is maintained at the 180° axis.

The thickness of the ferrite sleeve 30 is preferably selected so that it is most absorbent of surface currents at frequencies at the lower end of the operating frequency range of the antenna, which, as in the embodiment of the invention herein shown, would be in the range of 6 or 7 GHz. As described by Naito and Suetake in their article entitled "Application of Ferrite to Electromagnetic Wave Absorber and Its Characteristics", IEEE Transactions on Microwave Theory and Techniques, Vol. MIT-19, No. 1, January, 1971, ferrite materials have two matching frequencies at two respective matching thicknesses at which the ferrite would be a perfect absorber of radiation. It has been found that the use of a ferrite sleeve having a matching frequency at the lower end of the antenna frequency range significantly suppresses back lobe radiation at the low frequency end as a result of this absorption, and the increased lossiness of the ferrite sleeve 30 to radiation at higher frequencies also suppresses back lobe radiation at the high end of the antenna frequency band. A ferrite sleeve having a thickness in the range of 160 to 200 mils was found to produce a matching or absorbent frequency at 6 GHz, and produced the desired suppression of back lobe radiation at the low end of the antenna frequency band as well as at the higher end of the band.

It will be appreciated from the foregoing description that a cavity-backed spiral antenna is provided by this invention in which back lobe radiation is substantially reduced over a wide frequency range, while the forward lobe radiation of the antenna is essentially unaffected. It will also be appreciated that modifications to this embodiment of the invention may be made without necessarily departing from the spirit and scope of the invention.

What is claimed is:

1. In an antenna comprising a back conducting surface and a front radiation surface and a cylindrical conducting portion extending between said front and back surfaces, said cylindrical conducting portion having an outer conducting surface and defining an interior cavity portion extending between said back and front surfaces, the improvement which consists of: a ferrite sleeve placed eternal to and disposed around the entire outer peripheral portion of said outer conducting surface and surrounding said cavity portion, said ferrite sleeve being solid and self-supporting, and being the final outer exterior side of the antenna, whereby said ferrite sleeve is effective to significantly reduce back lobe radiation from said back surface while front lobe radiation from said radiation surface is substantially unaffected.

2. In the antenna of claim 1, in which said radiation surface includes a pair of interweaved spiral conductors connected respectively to first and second conducting lands, said lands being in energy-receiving communication with said back surface.

3. In the antenna of claims 1, or 2, in which the thickness of said ferrite sleeve is selected so that said ferrite sleeve is absorbent to surface currents on the cavity portion at frequencies at the lower end of the operating frequency range of the antenna.

4. In an antenna comprising a back conducting surface and a front radiation surface and a cylindrical conducting portion extending between said front and back surfaces, said cylindrical conducting portion having an outer conducting surface and defining an interior cavity portion extending between said back and front surfaces, the improvement which comprises: a ferrite sleeve placed external to and disposed around substantially the entire outer peripheral portion of said outer conducting surface and surrounding said cavity portion, in which said ferrite sleeve is of a thickness between 160 and 200 mils and provides relatively high back lobe suppression of signals in the range of 6 GHz, whereby said ferrite sleeve is effective to significantly reduce back lobe radiation from said back surface while front lobe radiation from said radiation surface is substantially unaffected.

5. In the antenna system of claims 1, or 3, in which the radiation absorption characteristics of said ferrite sleeve are substantially uniform over the entire surface area thereof.

6. In an antenna comprising a back conducting surface and a front radiation surface and a cylindrical conducting portion extending between said front and back surfaces, said cylindrical conducting portion having an outer conducting surface and defining an interior cavity portion extending between said back and front surfaces, the improvement which consists essentially of: a ferrite sleeve placed external to and disposed around the entire outer peripheral portion of said outer conduction surface and surrounding said cavity portion, said ferrite sleeve being solid and self-supporting, and being the final outer exterior side of the antenna, whereby said ferrite sleeve is effective to significantly reduce back lobe radiation from said back surface while front lobe radiation from said radiation surface is substantially unaffected.

7. In an antenna comprising a back conducting surface and a front radiation surface and a cylindrical conducting portion extending between said front and back surfaces, said cylindrical conducting portion having an outer conducting surface and defining an interior cavity portion extending between said back and front surfaces, the improvement which comprises: a ferrite sleeve placed external to and disposed around the entire outer peripheral portion of said outer conducting surface and surrounding said cavity portion, said ferrite sleeve being solid and self-supporting and consisting of the final outer exterior side of the antenna, whereby said ferrite sleeve is effective to significantly reduce back lobe radiation from said back surface while front lobe radiation from said radiation surface is substantially unaffected.

* * * * *